US009785099B2

(12) United States Patent
Takahashi et al.

(10) Patent No.: US 9,785,099 B2
(45) Date of Patent: Oct. 10, 2017

(54) IMAGE FORMING APPARATUS

(71) Applicant: FUJI XEROX CO., LTD., Tokyo (JP)

(72) Inventors: Masaaki Takahashi, Kanagawa (JP); Yoshiyuki Tominaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/844,758

(22) Filed: Sep. 3, 2015

(65) Prior Publication Data

US 2016/0223954 A1 Aug. 4, 2016

(30) Foreign Application Priority Data

Feb. 3, 2015 (JP) ..... 2015-019432

(51) Int. Cl.
*G03G 15/00* (2006.01)
*G03G 15/16* (2006.01)
*G03G 21/00* (2006.01)

(52) U.S. Cl.
CPC ..... *G03G 15/168* (2013.01); *G03G 15/1605* (2013.01); *G03G 21/0035* (2013.01); *G03G 2215/0129* (2013.01)

(58) Field of Classification Search
CPC ..... G03G 15/168; G03G 21/0035; G03G 2215/1661
USPC ..... 399/71, 353, 354
See application file for complete search history.

(56) References Cited

U.S. PATENT DOCUMENTS

| | | | | |
|---|---|---|---|---|
| 4,931,839 | A * | 6/1990 | Tompkins et al. | 399/66 |
| 6,311,031 | B1 * | 10/2001 | Hirano | 399/101 |
| 6,941,101 | B2 * | 9/2005 | Kato | 399/297 |
| 2010/0067936 | A1 * | 3/2010 | Kitajima | 399/72 |
| 2011/0318682 | A1 * | 12/2011 | Takahashi et al. | 430/105 |
| 2013/0148993 | A1 * | 6/2013 | Aoki et al. | 399/66 |

FOREIGN PATENT DOCUMENTS

| | | |
|---|---|---|
| JP | 2-287481 A | 11/1990 |
| JP | 2008-15506 A | 1/2008 |

* cited by examiner

*Primary Examiner* — Benjamin Schmitt
(74) *Attorney, Agent, or Firm* — Sughrue Mion, PLLC

(57) ABSTRACT

An image forming apparatus includes a first forming unit that forms a first image with a substantially flat toner containing a substantially flat metal pigment on a moving movable body; a second forming unit that forms a second image with a substantially non-flat toner on the movable body; a transfer unit that forms a nip with the movable body while circulating and transfers the first image and the second image on a medium transported to the nip; a removing unit that includes a rotational body and removes the toners adhering to the transfer unit, the rotational body having an axis and being configured to rotate around the axis; and a controller that, if the controller causes the first forming unit to form the first image, stops the rotation of the rotational body around the axis.

7 Claims, 16 Drawing Sheets

IMAGE FORMING APPARATUS

CROSS-REFERENCE TO RELATED APPLICATIONS

This application is based on and claims priority under 35 USC 119 from Japanese Patent Application No. 2015-019432 filed Feb. 3, 2015.

BACKGROUND

The present invention relates to an image forming apparatus.

SUMMARY

According to an aspect of the invention, there is provided an image forming apparatus including a first forming unit that forms a first image with a substantially flat toner containing a substantially flat metal pigment on a moving movable body; a second forming unit that forms a second image with a substantially non-flat toner on the movable body; a transfer unit that forms a nip with the movable body while circulating and transfers the first image and the second image on a medium transported to the nip; a removing unit that includes a rotational body and removes the toners adhering to the transfer unit, the rotational body having an axis and being configured to rotate around the axis; and a controller that, if the controller causes the first forming unit to form the first image, stops the rotation of the rotational body around the axis.

BRIEF DESCRIPTION OF THE DRAWINGS

Exemplary embodiments of the present invention will be described in detail based on the following figures, wherein.

DETAILED DESCRIPTION

Overview

Figure 1:
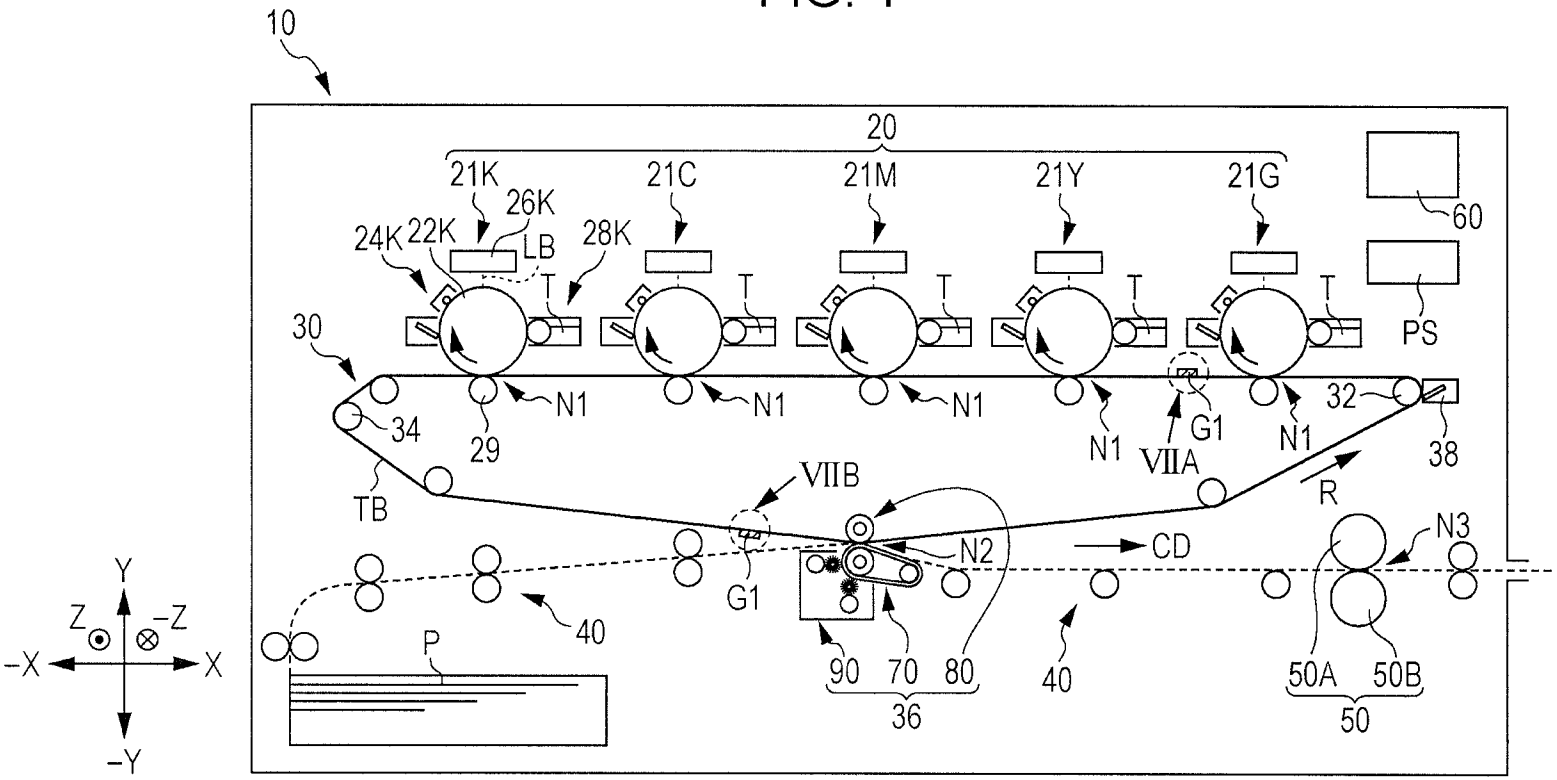
FIG. 1 is schematic view (front view) of an image forming apparatus according to a first exemplary embodiment.

Exemplary embodiments for implementing the invention (hereinafter, referred to as exemplary embodiments) are described below. In the description of the exemplary embodiments, first to fourth exemplary embodiments are provided. In the following description, directions indicated by arrow X and arrow −X in the drawings represent an apparatus width direction, and directions indicated by arrow Y and arrow −Y in the drawings represent an apparatus height direction. Also, directions (arrow Z and arrow −Z directions) orthogonal to the apparatus width direction and the apparatus height direction represent an apparatus depth direction.

First Exemplary Embodiment

This exemplary embodiment is described below with reference to the drawings. First, a configuration of an image forming apparatus 10 (see FIG. 1) according to this exemplary embodiment is described. Then, an image forming operation of the image forming apparatus 10 of this exemplary embodiment is described. Then, effects of this exemplary embodiment are described.

Configuration of Image Forming Apparatus

First, a general configuration of the image forming apparatus 10 is described, and then, major portions (a transfer device 30, a second transfer unit 36 (see FIG. 3) configuring the transfer device 30, and a toner (see FIGS. 4 and 5) used by the image forming apparatus 10) are described.

General Configuration of Image Forming Apparatus

As shown in FIG. 1, the image forming apparatus 10 is an electrophotographic apparatus including a toner image forming unit 20, a transfer device 30, a transport device 40, a fixing device 50, a controller 60, and a power supply PS. In the image forming apparatus 10 of this exemplary embodiment, an example of a medium P on which an image may be formed is a cut sheet.

Toner Image Forming Unit

The toner image forming unit 20 has a function of forming a toner image G1 (see FIGS. 1 and 6) and a non-transfer image G2 (see FIG. 6) held on a transfer belt TB (described later), which configures the transfer device 30, by executing respective processes of electric charge, exposure, and development. In this exemplary embodiment, the toner image G1 represents a toner image to be second transferred on a medium P. In contrast, the non-transfer image G2 is not a toner image to be second transferred, but the non-transfer image G2 is a toner image to be formed for maintaining an electrically charged state etc. of respective toners MT and NT (for example, for restricting excessive electric charge of the toners MT and NT) housed in developing devices 28G, 28Y, 28M, 28C, and 28K (described later). For example, the image forming apparatus 10 of this exemplary embodiment is configured such that the non-transfer image G2 is first transferred on a portion of the transfer belt TB which does not contact the medium P at a nip N2 (described later) of the transfer belt TB, and the non-transfer image G2 is removed by a blade 38 (described later) (see FIG. 6). In the following description, the toners MT and NT are described as a toner T unless otherwise the toner MT and the toner NT are particularly required to be distinguished from one another.

The toner image forming unit 20 includes single-color units 21G, 21Y, 21M, 21C, and 21K that form toner images G1 of different colors (G (gold), Y (yellow), M (magenta), C (cyan), K (black)). The single-color units 21G, 21Y, 21M, 21C, and 21K have similar configurations except the colors of the respectively formed toner images G1. Hereinafter, in the specification and drawings, the alphabets (G, Y, M, C, K) of the single-color units 21G, 21Y, 21M, 21C, and 21K are omitted unless otherwise the single-color units 21G, 21Y, 21M, 21C, and 21K and their components are required to be distinguished from one another. The single-color unit 21G forms a toner image G1 and a non-transfer image G2 with a flat or substantially flat toner MT (hereinafter, referred to as toner MT, see FIG. 4), which is described later, on the transfer belt TB (described later). The single-color units 21 other than the single-color unit 21G each form a toner image G1 and a non-transfer image G2 with a non-flat or substantially non-flat toner NT (hereinafter, referred to as toner NT, see FIG. 5), which is described later, on the transfer belt TB. The toner MT and the toner NT of this exemplary embodiment each have, for example, negative polarity (average of charge amount distribution is negative). The single-color unit 21G is an example of a first forming unit, and the single-color units 21 other than the single-color unit 21G are each an example of a second forming unit. Also, the toner image G1 formed by the single-color unit 21G is an example of a first image, and the toner image G1 formed by each of the single-color units 21 other than the single-color unit 21G is an example of a second image.

Figure 2:
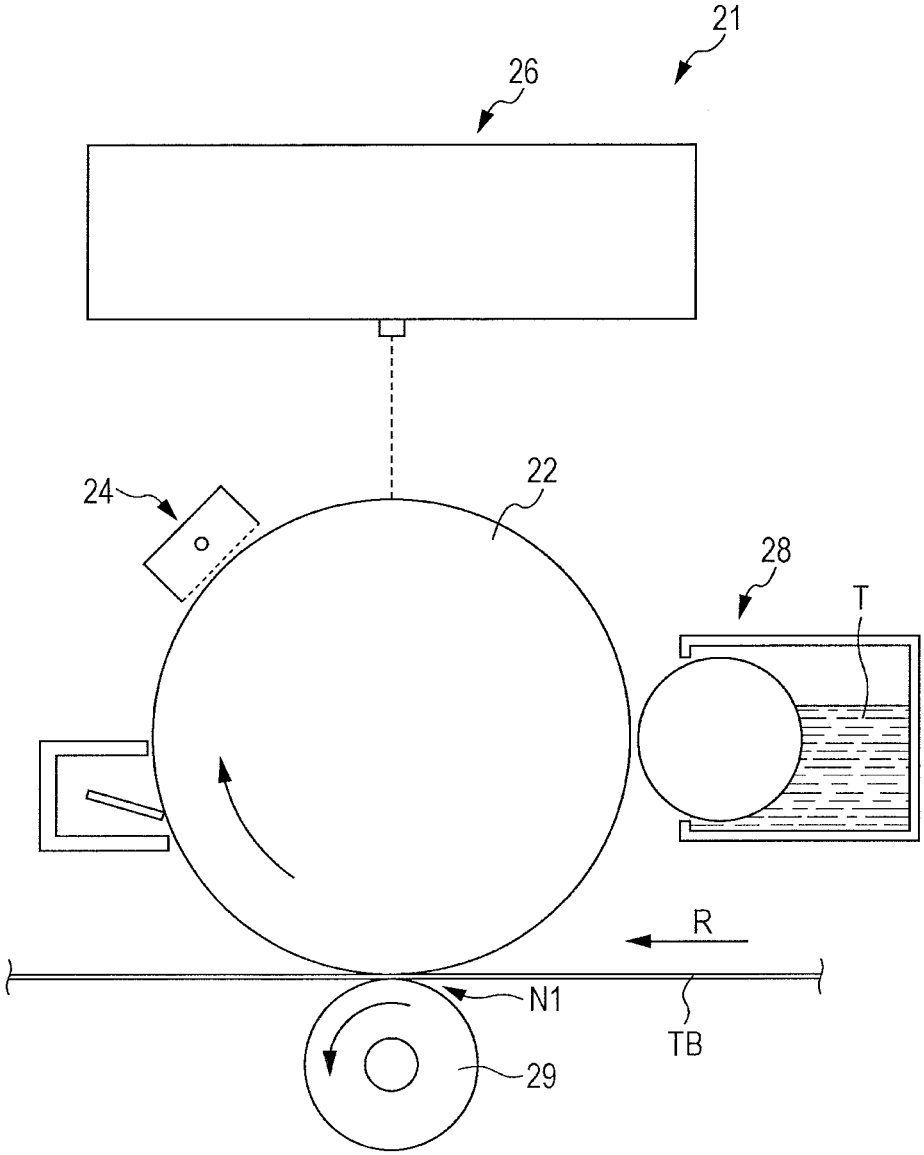
FIG. 2 is a schematic view (front view) of a toner image forming unit configuring the image forming apparatus according to the first exemplary embodiment.

As shown in FIGS. 1 and 2, each single-color unit 21 includes a photoconductor 22, a charging device 24, an exposure device 26, a developing device 28, and a first transfer roller 29. The photoconductor 22 is cylindrical, and its axis (representing the axis of the photoconductor 22) is arranged along the apparatus depth direction. The first transfer roller 29 forms a nip N1 with the photoconductor 22 with the transfer belt TB interposed therebetween. The charging device 24 electrically charges the photoconductor 22, the exposure device 26 exposes the photoconductor 22 rotating around its axis, to light, and the developing device 28 develops the toner image G1 and the non-transfer image G2. Thus, each single-color unit 21 forms the toner image G1 and the non-transfer image G2 on the photoconductor 22. Also, a first transfer voltage (voltage with positive polarity) is applied from the power supply PS to each first transfer roller 29, and hence the first transfer roller 29 first transfers the toner image G1 and the non-transfer image G2 formed on the photoconductor 22, on the moving (circulating) transfer belt TB at the nip N1. The exposure device 26 forms, for example, a latent image on the photoconductor 22 with a minimum exposure dot corresponding to 1200 dpi× 1200 dpi (about 21 μm×about 21 μm). In FIG. 1, the reference signs for the components of the single-color units 21 other than those of the single-color unit 21K are omitted.

Transfer Device

The transfer device 30 has a function of second transferring the toner images G1 and the non-transfer image G2 of the respective colors formed by the respective single-color units 21 and first transferred at the nips N1, on a medium P transported to a nip N2 (described later). The configuration of the transfer device 30 is described later.

Transport Device

The transport device 40 has a function of transporting a medium P. If image formation is executed on plural media P during an image forming operation, the transport device 40 transports the plural media P at predetermined intervals interposed among the continuously transported media P.

Fixing Device

The fixing device 50 has a function of applying heat and pressure at a nip N3 to the toners T configuring the toner images G1 of the respective colors second transferred on the medium P by the transfer device 30, and hence fixing the toners T to the medium P. The fixing device 50 includes a heating portion 50A and a pressing portion 50B.

Controller

The controller 60 has a function of controlling respective units other than the controller 60 configuring the image forming apparatus 10.

Figure 8:
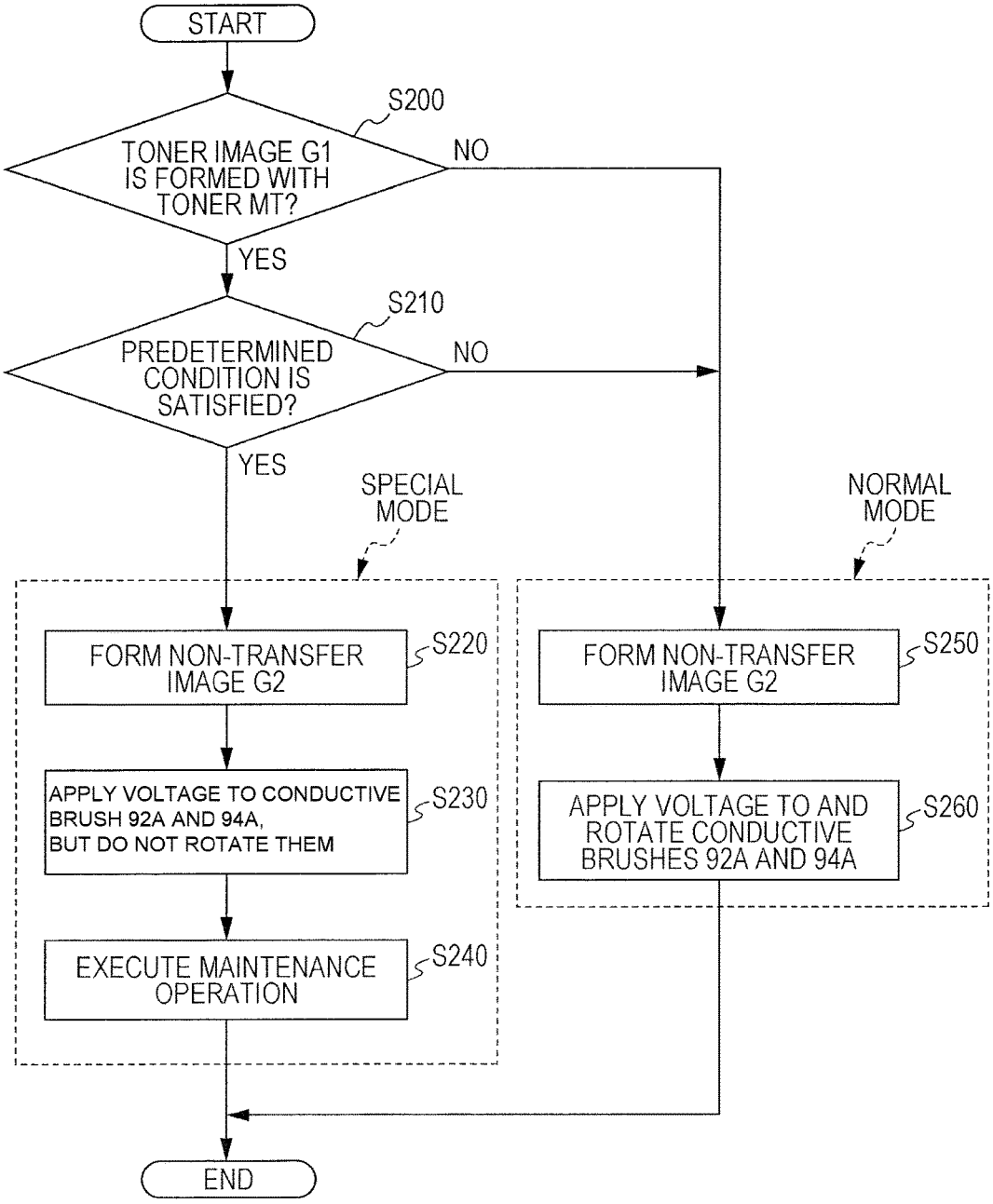
FIG. 8 is a flowchart when a controller configuring the image forming apparatus according to the first exemplary embodiment controls the second transfer unit during a transfer operation.

The controller 60 receives image data from an external device (not illustrated). The controller 60 which has received the image data controls the respective units other than the controller 60 configuring the image forming apparatus 10 by following, for example, a flowchart in FIG. 8. The controller 60 that executes control shown in the flowchart in FIG. 8 is described in detail in the description for an image forming operation of the image forming apparatus 10. In this section, a predetermined condition in step S210 in the flowchart in FIG. 8 is described. When the controller 60 receives image data from an external device, the controller 60 receives other data (for example, data indicating the number of media P, on which images are formed), from the external device. Also, the controller 60 causes the image forming apparatus 10 to execute the image forming operation in accordance with job data (data containing image data and data indicating the number of media P, or command).

If the controller 60 determines that a toner image G1 with a gold-color toner MT satisfies a predetermined condition (if the controller 60 determines YES), the controller 60 causes the image forming apparatus 10 to execute an image forming operation in a special mode. In contrast, if the controller 60 determines that the condition is not satisfied (if the controller 60 determines NO) in determining step S210, the controller 60 causes the image forming apparatus 10 to execute an image forming operation in a normal mode. The specific contents of the special mode and the normal mode are described later.

Predetermined Condition

Figure 9:
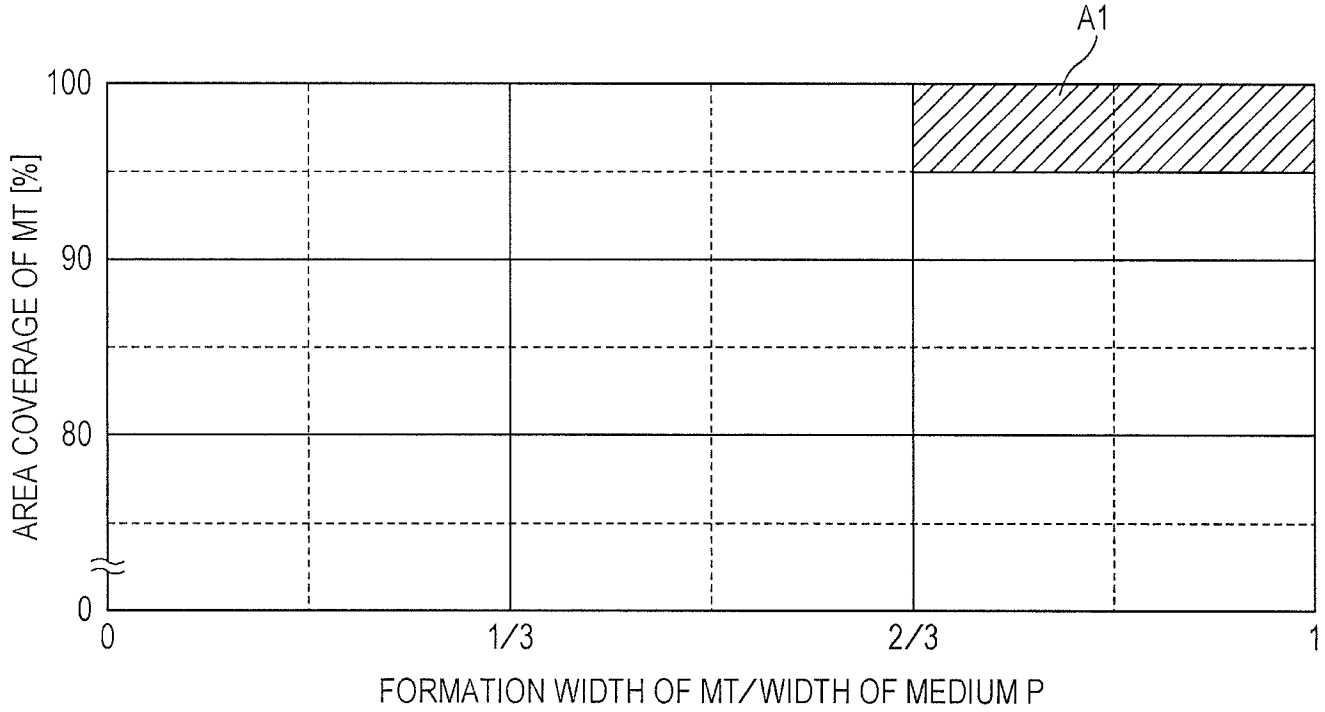
FIG. 9 is a schematic view showing a predetermined condition of the controller in the flowchart in FIG. 8, in the image forming apparatus according to the first exemplary embodiment.

For example, as shown in FIG. 9, the predetermined condition uses a ratio of a formation width of the toner MT (the maximum width in which the toner MT is formed) with respect to the width of a medium P, and an area coverage [%] of the toner MT as parameters. In this exemplary embodiment, it is assumed that the predetermined condition is satisfied if the ratio of the formation width of the toner MT with respect to the width of the medium P on which image formation is actually executed in accordance with job data is ⅔ or larger (1 or smaller) and the area coverage of the toner MT is 95% or higher (100% or lower) (if the toner image G1 is included in a region A1 in FIG. 9). The area coverage of the toner MT represents the percentage of the pixels in the axial direction of the photoconductor 22G that is exposed to light by the exposure device 26G (the pixels in the axial direction of the photoconductor 22G having the toner image G1 with the toner MT that is developed by the developing device 28) with respect to the pixels included in the formation width of the toner MT when the minimum exposure dot formed by the exposure device 26G on the photoconductor 22G is one pixel. For example, if the area coverage of the toner MT is 100%, the toner MT is developed and transferred in all pixels included in the formation width of the toner MT. Also, if the area coverage of the toner MT is 50%, the toner MT is developed and transferred in half of pixels included in the formation width of the toner MT. In this exemplary embodiment, the basis of the determination that the predetermined condition is satisfied if the toner image G1 is included in the region A1 in FIG. 9 is described later.

The above description is for the general configuration of the image forming apparatus 10 of this exemplary embodiment.

Configuration of Major Portions of Image Forming Apparatus

Next, the transfer device 30, the second transfer unit 36 configuring the transfer device 30, and the toners MT and NT used in the image forming apparatus 10 being major portions of the image forming apparatus 10 are described with reference to the drawings.

Transfer Device

As shown in FIG. 1, the transfer device 30 includes the transfer belt TB, a driving roller 32, a tension roller 34, the second transfer unit 36, and a blade 38.

Transfer Belt, Driving Roller, and Tension Roller

The transfer belt TB is endless. The driving roller 32 is driven by a driving source (not illustrated), and moves the transfer belt TB in the arrow R direction while rotating around its axis. The tension roller 34 presses the transfer belt TB from the inner periphery side, and gives a tension to the transfer belt TB. With the above-described configuration, the toner images G1 and the non-transfer images G2 of the respective colors formed by the respective single-color units 21 are first transferred on the transfer belt TB while the transfer belt TB moves in the arrow R direction. The transfer belt TB causes the toner images G1 and the non-transfer images G2 of the respective colors to reach the nip N2 while being held on the outer periphery. The transfer belt TB is an example of a movable body.

Second Transfer Unit

Figure 3:
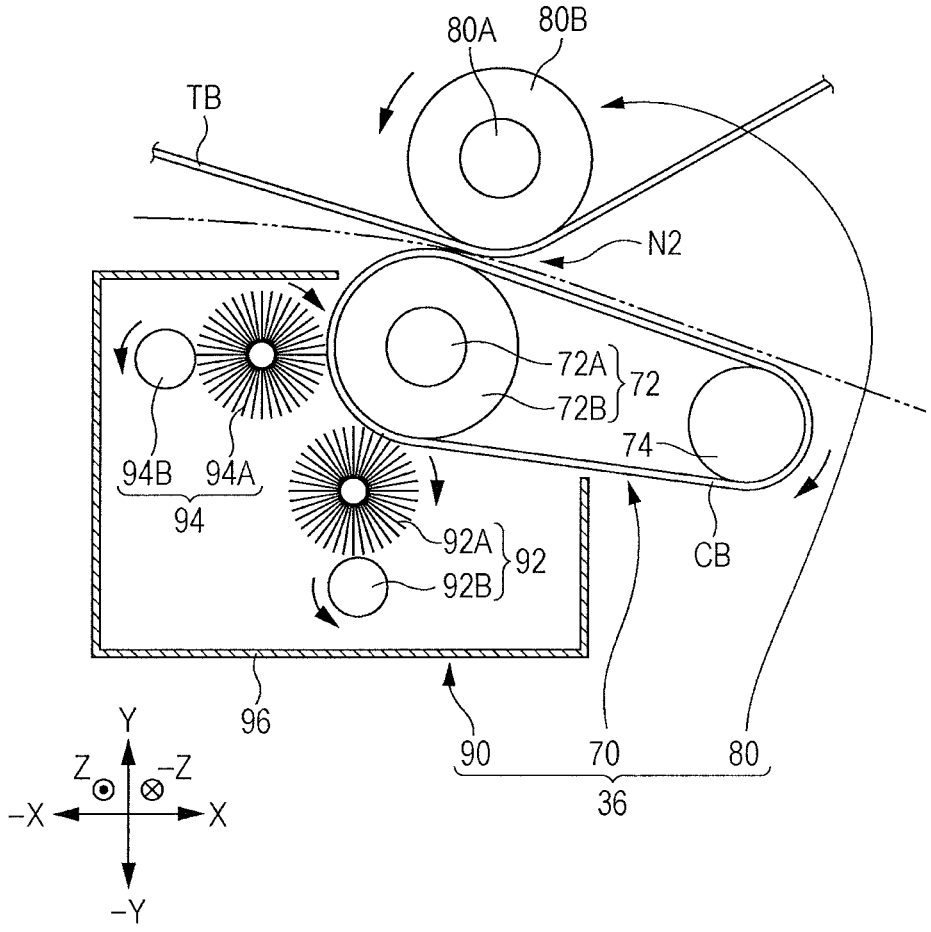
FIG. 3 is a schematic view of a peripheral area of a second transfer unit of a transfer device configuring the image forming apparatus according to the first exemplary embodiment.

The second transfer unit 36 has a function of second transferring the toner images G1 of the respective colors held on the transfer belt TB, on a medium P transported by the transport device 40. As shown in FIGS. 1 and 3, the second transfer unit 36 includes a second transfer portion 70, a backup roller 80 (hereinafter, referred to as BUR 80), and a removing unit 90.

Second Transfer Portion and BUR

The second transfer portion 70 includes a conductive roller 72, a tension roller 74, and a conductive belt CB. The conductive belt CB is an example of a transfer unit.

The conductive belt CB has a function of forming the nip N2 with the transfer belt TB while the conductive belt CB circulates, and transferring a toner image G1 on a medium P transported to the nip N2 by the transport device 40. The conductive roller 72 includes a shaft 72A, and a cylindrical conductive layer 72B. The conductive roller 72 is driven by a driving source (not illustrated) and rotates around its axis. The conductive belt CB is endless, and is wound around the cylindrical conductive layer 72B. The tension roller 74 presses the conductive belt CB from the inner periphery side, and gives a tension to the conductive belt CB. With the above-described configuration, in the second transfer portion 70, the conductive belt CB circulates when the conductive roller 72 rotates around its axis. The shaft 72A of the conductive roller 72 is grounded.

As shown in FIGS. 1 and 3, the BUR 80 is arranged at the opposite side (upper side) of the second transfer portion 70 with the transfer belt TB interposed therebetween. Also, the BUR 80 causes the conductive belt CB and the transfer belt TB to form the nip N2 at a position offset with respect to the conductive roller 72.

The BUR 80 includes a shaft 80A, and a cylindrical conductive layer 80B. A voltage is applied from the power supply PS (see FIG. 1) to the shaft 80A of the BUR 80. To be specific, a second transfer voltage (voltage with negative polarity) is applied from the power supply PS to the BUR 80 when a medium P passes through the nip N2. Consequently, the conductive belt CB forms an electric field for second transferring the toner image G1 on the medium P at the nip N2 together with the transfer belt TB. Also, a voltage with positive polarity is applied from the power supply PS to the BUR 80 before and after the medium P passes through the nip N2. Consequently, the conductive belt CB forms an electric field for causing the transfer belt TB to hold the non-transfer image G2 at the nip N2 together with the transfer belt TB.

With the above-described configuration, the conductive belt CB forms the nip N2 together with the transfer belt TB while circulating, and transfers the toner image G1 on the transported medium P in a period in which the medium P passes through the nip N2. Also, the conductive belt CB forms the nip N2 together with the transfer belt TB while circulating, and allows the transfer belt TB to pass through the nip N2 while the transfer belt TB holds the non-transfer image G2 before and after the medium P passes through the nip N2.

Removing Unit

The removing unit 90 has a function of removing a toner T adhering to the conductive belt CB. As shown in FIG. 3, the removing unit 90 includes a first removing portion 92, a second removing portion 94, and a housing 96. The first removing portion 92 and the second removing portion 94 are arranged in the housing 96.

The first removing portion 92 has a function of removing a toner T electrically charged with negative polarity. The first removing portion 92 includes a conductive brush 92A and a metal shaft 92B. The conductive brush 92A and the metal shaft 92B are each an example of a rotational body. Also, the metal shaft 92B is an example of a removing portion. The conductive brush 92A contacts (bites into) a portion of the conductive belt CB wound around the conductive roller 72. Also, the conductive brush 92A contacts the metal shaft 92B at a portion different from a portion of the conductive brush 92A biting into the conductive belt CB. The conductive brush 92A and the metal shaft 92B are arranged so that the axial directions of the conductive brush 92A and the metal shaft 92B are aligned with the axial direction of the conductive roller 72.

The second removing portion 94 has a function of removing a toner T electrically charged with positive polarity. The second removing portion 94 is arranged at a portion located downstream of the first removing portion 92 and located upstream of the nip N2 in a circulation direction of the conductive belt CB. The second removing portion 94 includes a conductive brush 94A and a metal shaft 94B. The conductive brush 94A and the metal shaft 94B are each another example of a rotational body. Also, the metal shaft 94B is an example of a removing portion. The conductive brush 94A contacts a portion of the conductive belt CB, the portion which is wound around the conductive roller 72 and is different from the portion into which the conductive brush 92A bites. Also, the conductive brush 94A contacts the metal shaft 94B at a portion of the conductive brush 94A different from a portion biting into the conductive belt CB. The conductive brush 94A and the metal shaft 94B are arranged so that the axial directions of the conductive brush 92A and the metal shaft 92B are aligned with the axial direction of the conductive roller 72.

When the metal shaft 94B is driven by a driving source (not illustrated), the metal shaft 94B rotates counterclockwise in a view from the near side in the apparatus depth direction. Also, a torque is transmitted to the conductive brushes 92A and 94A, and the metal shaft 92B through a gear (not illustrated) meshing with a gear (not illustrated) provided at the metal shaft 94B. Consequently, the metal shaft 92B rotates counterclockwise, and the conductive brushes 92A and 94A rotate clockwise. As described above, in this exemplary embodiment, the conductive brushes 92A and 94A, and the metal shaft 92B are rotated when the metal shaft 94B rotates, and are stopped when the metal shaft 94B stops.

When a voltage with positive polarity is applied from the power supply PS to the metal shaft 92B, the conductive brush 92A is electrically charged with positive polarity and rotates around its axis. The conductive brush 92A transfers a toner T with negative polarity from the conductive belt CB, and then the metal shaft 92B removes the toner T from the conductive brush 92A. That is, a voltage that causes the toner T with negative polarity to be transferred from the conductive belt CB is applied to the conductive brush 92A. When a voltage with negative polarity is applied from the power supply PS to the metal shaft 94B, the conductive brush 94A is electrically charged with negative polarity and rotates around its axis. The conductive brush 94A transfers a toner T with positive polarity from the conductive belt CB, and then the metal shaft 94B removes the toner T from the conductive brush 94A. That is, a voltage that causes the toner T with positive polarity to be transferred from the conductive belt CB is applied to the conductive brush 94A. The toners T removed by the metal shafts 92B and 94B are scraped by blades (not illustrated) from the metal shafts 92B and 94B, and are housed in the housing 96.

Blade

The blade 38 has a function of removing a toner T not second transferred on a medium P transported to the nip N2 but remaining on the transfer belt TB and a toner T configuring the non-transfer image G2 held on the transfer belt TB from the transfer belt TB. As shown in FIG. 1, the blade 38 contacts the transfer belt TB at a position located downstream of the nip N2 and upstream of the toner image forming unit 20 (the single-color unit 21G) in the moving direction of the transfer belt TB (the arrow R direction).

Toner

Flat Toner (Toner MT)

Figure 4:
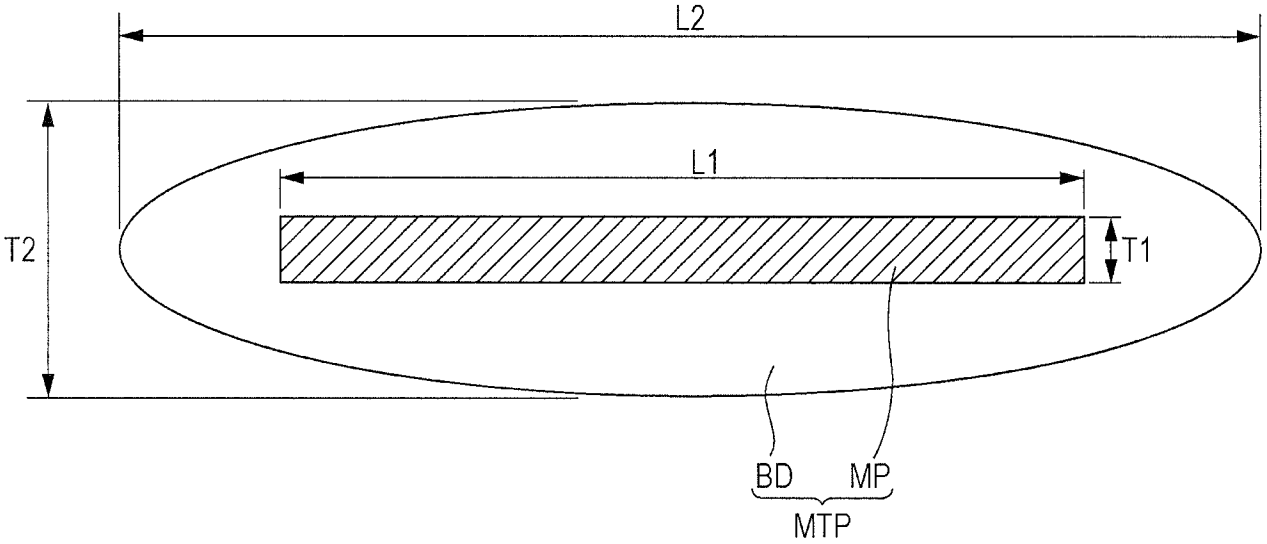
FIG. 4 is a schematic view (cross-sectional view) of a toner particle of a flat toner that is used by the image forming apparatus according to the first exemplary embodiment.

As shown in FIG. 4, for example, a toner particle MTP configuring the toner MT contains a metal pigment MP and a binder BD. The binder BD covers the metal pigment MP. The metal pigment MP is flat or substantially flat. To be specific, the metal pigment MP has a long-axis length L1, for example, in a range from 5 μm to 12 μm, and a thickness T1, for example, in a range from 0.01 μm to 0.5 μm. In this case, the long-axis length L1 represents a length of a portion with the largest length of the metal pigment MP when the metal pigment MP is viewed in a direction orthogonal to the thickness direction of the metal pigment MP. The toner particle MTP of this exemplary embodiment has a long-axis length L2, for example, in a range from 7 μm to 20 μm, and a thickness T2, for example, in a range from 1 μm to 3 μm. In this case, the long-axis length L2 represents a length of a portion with the largest length of the toner particle MTP when the toner particle MTP is viewed in a direction orthogonal to the thickness direction of the toner particle MTP. As described above, the toner particle MTP of this exemplary embodiment is a toner particle having relationships that (long-axis length L1)/(thickness T1) of the contained metal pigment MP is, for example, in a range from 10 to 1200, and (long-axis length L2)/(thickness T2) of the toner particle MTP is, for example, in a range from 2.3 to 20 (the toner MT of this exemplary embodiment being a group of the toner particles MTP having the above-described relationships). As described above, the toner MT of this exemplary embodiment is gold color. The gold color is made by using, for example, aluminum for the metal pigment MP configuring the toner particle MTP, and dispersing, for example, a pigment of yellow (Y) in the binder BD.

Non-Flat Toner (Toner NT)

Figure 5:
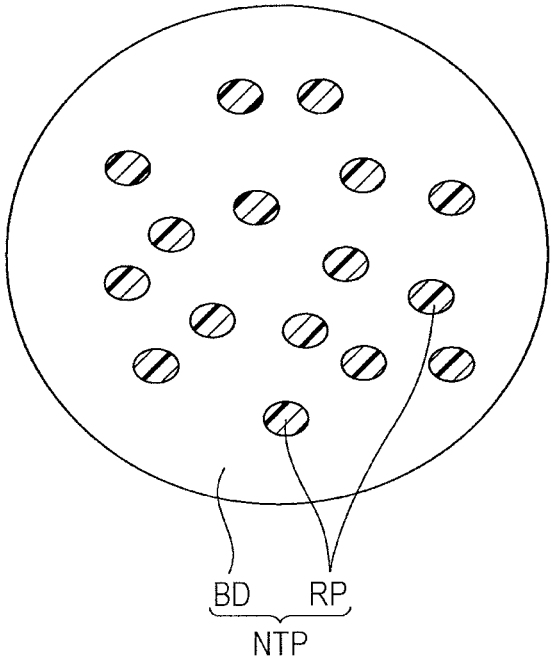
FIG. 5 is a schematic view (cross-sectional view) of a toner particle of a non-flat toner that is used by the image forming apparatus according to the first exemplary embodiment.

As shown in FIG. 5, a toner particle NTP configuring the toner NT contains, for example, a resin pigment RP and a binder BD. Also, the toner particle NTP is not flat. To be specific, the toner particle NTP of this exemplary embodiment represents a toner particle having relationships that (long-axis length)/(thickness) of the contained resin pigment RP is, for example, smaller than 10, and (long-axis length)/(thickness) of the toner particle NTP is, for example, smaller than 2.3. Also, the circularity of the toner particle NTP of this exemplary embodiment when the toner particle NTP is projected on a flat plane is, for example, 0.90 or larger. Thus, the toner particle NTP (the toner NT) of this exemplary embodiment is a non-flat toner particle (a toner).

The above description is for the configurations of the major portions of the image forming apparatus 10 and the toners MT and NT used by the image forming apparatus 10 according to this exemplary embodiment.

Supplemental Explanation

Supplemental explanation is given below for the configuration of the image forming apparatus 10 of this exemplary embodiment.

Supplemental Explanation 1

Figure 7A:
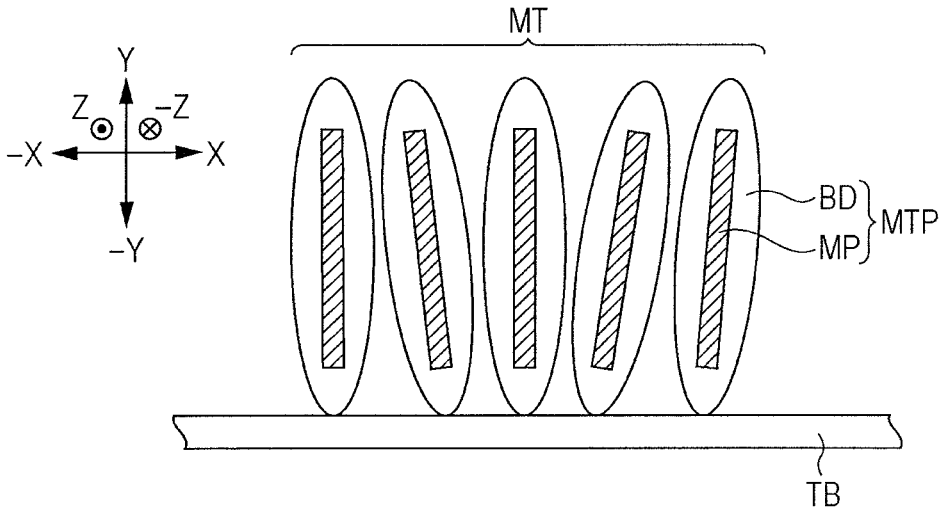
FIGS. 7A and 7B are each an illustration showing a flat toner held on a transfer belt of the image forming apparatus according to the first exemplary embodiment, FIG. 7A being a schematic view showing a flat toner configuring a toner image within a dotted-line area VIIA in FIG. 1, FIG. 7B being a schematic view showing a flat toner configuring a toner image within a dotted-line area VIIB in FIG. 1.
Figure 7B:
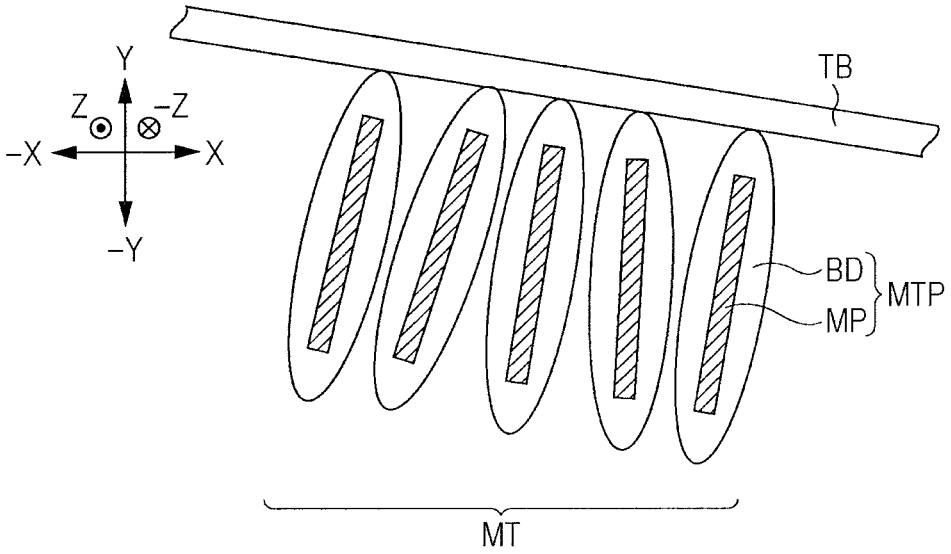

As shown in each of FIGS. 7A and 7B, the toner MT is held at the transfer belt TB in a state (a standing state) in which the long axis (the axis in the longitudinal direction) of the toner MT is along a direction substantially orthogonal to the outer periphery of the transfer belt TB while the toner MT moves with the transfer belt TB at a portion other than the nip N1 and N2. This may be expectedly because the toner MT is polarized in the direction along the long-axis direction of the toner MT. Also, the toner MT adhering to the transfer belt TB in the standing state changes in posture expectedly because the toner MT is pinched by the photoconductor 22 and the transfer belt TB at the nip N1 and is pinched by the conductive belt CB of the second transfer portion 70 and the transfer belt TB at the nip N2.

Supplemental Explanation 2

As described above, in the image forming apparatus 10 according to this exemplary embodiment, the non-transfer image G2 is first transferred on a portion (inter-image portion) of the transfer belt TB, the portion which does not contact a medium P at the nip N2. A portion surrounded by a broken line PA in FIG. 6 indicates a portion of the transfer belt TB which contacts a medium P at the nip N2. Also, in this exemplary embodiment, a portion arranged between portions surrounded by two neighbor broken lines PA on the transfer belt TB is a portion of the transfer belt TB on which the non-transfer image G2 is first transferred.

Supplemental Explanation 3

As described above, in the image forming apparatus 10 of this exemplary embodiment, when the toner image G1 is formed by using the single-color unit 21G, an image using the flat metal pigment MP as a coloring matter is formed. When an image is formed by using the toner MT configured of the toner particle MTP containing the flat metal pigment MP, the image reflects light and hence has glossiness.

Image Forming Operation of Image Forming Apparatus

An image forming operation of the image forming apparatus 10 of this exemplary embodiment is described with reference to the drawings. In the following description, a basic operation of the image forming apparatus 10 is described first, and an operation executed every different image data received from an external device (not illustrated) is described next. In this case, the basic operation of the image forming apparatus 10 represents an operation that is executed commonly even if image data is different.

Basic Operation

The controller 60 which has received image data (for example, data for forming an image on plural media P) from an external device (not illustrated) activates the toner image forming unit 20, the transfer device 30, and the fixing device 50.

Figure 6:
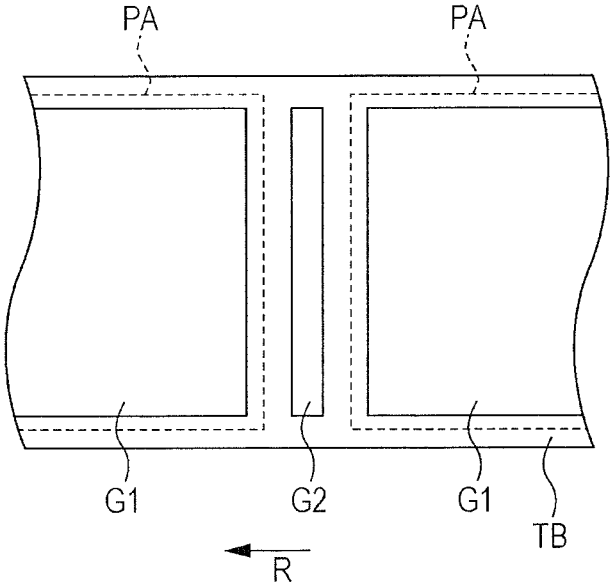
FIG. 6 is a schematic view showing a state in which a toner image and a non-transfer image are held by a transfer belt in the image forming apparatus according to the first exemplary embodiment.

The controller 60 causes the charging device 24 to electrically charge the photoconductor 22, causes the exposure device 26 to expose the photoconductor 22 to light, and causes the developing device 28 to develop a toner image G1 and a non-transfer image G2. Then, when the controller 60 causes the power supply PS to apply a first transfer voltage to each first transfer roller 29, the first transfer roller 29 first transfers the toner image G1 and the non-transfer image G2 on the moving transfer belt TB. Consequently, as shown in FIG. 6, the toner image forming unit 20 forms respective toner images G1 and respective non-transfer images G2 on the transfer belt TB.

Also, the controller 60 drives a driving source (not illustrated) of the conductive roller 72, the BUR 80, and the removing unit 90 of the second transfer unit 36, causes the conductive belt CB to circulate, causes the conductive brushes 92A and 94A to be rotated around their axes, and causes the heating portion 50A to be heated.

Then, the controller 60 causes the transport device 40 to transport a medium P to N2 in synchronization with a timing at which the respective toner images G1 first transferred and held on the transfer belt TB reach the nip N2 together with the transfer belt TB. Then, the controller 60 causes the power supply PS to apply a second transfer voltage to the shaft 80A of the BUR 80, and causes the toner image G1 held on the transfer belt TB to be second transferred on the medium P passing through the nip N2. Then, after the medium P passes through the nip N2, the controller 60 causes the power supply PS to apply a voltage with positive polarity to the shaft 80A, and causes the conductive belt CB to form an electric field for causing the transfer belt TB to hold the non-transfer image G2 on the transfer belt TB passing through the nip N2. Consequently, the non-transfer image G2 on the transfer belt TB is moved together with the transfer belt TB and is removed from the transfer belt TB by the blade 38.

Then, the controller 60 causes the transport device 40 to transport the medium P to the nip N3. The controller 60 causes the heating portion 50A to heat the toner image G1 second transferred on the medium P and causes the pressing portion 50B to press the toner image G1. Consequently, the toner image G1 on the medium P is fixed to the medium P, the medium P is output to the outside of the image forming apparatus 10 by the transport device 40, and the image forming operation of the image forming apparatus 10 is ended.

The toner T adhering to the conductive belt CB (for example, so-called fog toner) circulates together with the conductive belt CB, and is removed from the conductive belt CB by the conductive brushes 92A and 94A configuring the removing unit 90.

The above description is for the basic operation of the image forming apparatus 10.

Operation Per Image Data

Next, an operation per different image data received from an external device (not illustrated) is described (for example, the image data being data for forming an image on plural media P).

Operation if Image Data Forming Toner Image G1 with Toner MT is not Included In this case, as shown in FIG. 8, the controller 60 determines NO in determining step S200, and causes the image forming apparatus 10 to execute an image forming operation in the normal mode. To be specific, the controller 60 causes the single-color unit 21 that forms a toner image G1 with a color included in the image data to form a toner image G1 and a non-transfer image G2 (step S250). Also, the controller 60 causes the first removing portion 92 and the second removing portion 94 of the removing unit 90 configuring the second transfer unit 36 to be driven (causes the conductive brushes 92A and 94A to rotate around their axes), and causes the power supply PS to apply a voltage to the metal shafts 92B and 94B (step S260). Image formation on plural media P, which are requested for image formation, is executed and the image forming operation is ended.

Operation if Image Data Forming Toner Image G1 with Toner MT is Included

In this case, as shown in FIG. 8, the controller 60 determines YES under the condition in determining step S200, and makes determination in determining step S210.

If the controller 60 determines NO in determining step S210, the controller 60 causes the image forming apparatus 10 to execute an image forming operation in the normal mode. Image formation on plural media P, which are requested for image formation, is executed and the image forming operation is ended.

In contrast, if the controller 60 determines YES in determining step S210, the controller 60 causes the image forming apparatus 10 to execute an image forming operation in the special mode. To be specific, the controller 60 causes the single-color unit 21 that forms a toner image G1 with a color included in the image data to form a toner image G1 and a non-transfer image G2 (step S220). Also, the controller 60 does not cause the first removing portion 92 or the second removing portion 94 of the removing unit 90 configuring the second transfer unit 36 to be driven (does not cause the conductive brush 92A or 94A to rotate around its axis), and causes the power supply PS to apply a voltage to the metal shafts 92B and 94B (step S230). After the transfer operation for all toner images G1 and non-transfer images G2 on the plural media P requested for the transfer (second transfer) is ended, the controller 60 causes the second transfer unit 36 to execute a maintenance operation. To be specific, the controller 60 causes the power supply PS to apply a voltage to the metal shafts 92B and 94B, and causes the first removing portion 92 and the second removing portion 94 to be driven (causes the conductive brushes 92A and 94A and the metal shafts 92B and 94B to rotate plural times around their axes). Also, the controller 60 causes the conductive roller 72 of the second transfer portion 70 to rotate around its axis and causes the driving roller 32 of the transfer device 30 to rotate around its axis. Thus, the image forming operation is ended.

Effect

Next, effects of this exemplary embodiment are described.

First, effects (first to fourth effects) of this exemplary embodiment are described with reference to the drawings. In the following description, when effects of this exemplary embodiment are compared with effects of comparative exemplary embodiments, and when the components used in this exemplary embodiment are used in the comparative exemplary embodiments, the reference signs of the components are used without being changed.

First Effect

A first effect of this exemplary embodiment is an effect of not driving the first removing portion 92 or the second removing portion 94 in step S230 in the special mode if the controller 60 determines YES in determining step S200 and determining step S210 in FIG. 8.

For the first effect, the image forming apparatus 10 (the transfer device 30) of this exemplary embodiment is described in comparison with an image forming apparatus (a transfer device) of a comparative exemplary embodiment described below. The image forming apparatus (a controller) of the comparative exemplary embodiment is configured to drive the first removing portion 92 and the second removing portion 94 to be driven in step S230 in FIG. 8. The image forming apparatus of the comparative exemplary embodiment has a similar configuration to that of the image forming apparatus 10 (the transfer device 30) of this exemplary embodiment except the above-described point.

Figure 11A:
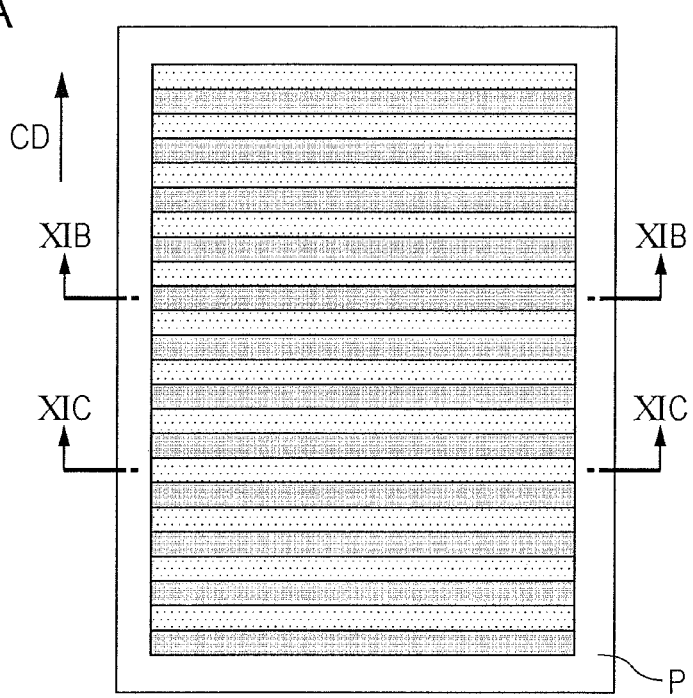
FIG. 11A is a schematic view showing an image on a medium formed by an image forming apparatus according to a comparative exemplary embodiment.
Figure 11B:
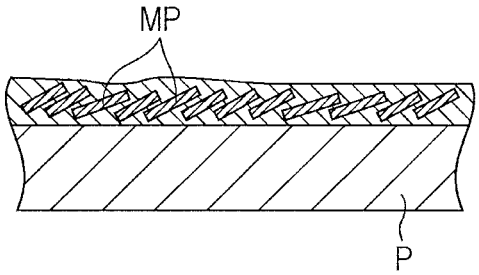
FIG. 11B is a partial cross-sectional view taken along line XIB-XIB in FIG. 11A.
Figure 11C:
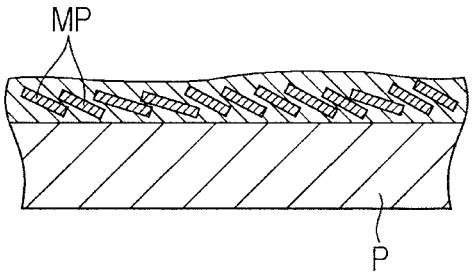
FIG. 11C is a partial cross-sectional view taken along line XIC-XIC in FIG. 11A.

In the case of the image forming apparatus of the comparative exemplary embodiment, if the controller 60 determines YES in determining step S200 and in determining step S210, the toner image G1 on the transfer belt TB is second transferred on a medium P at the nip N2 while the first removing portion 92 and the second removing portion 94 are driven (rotated). If the metal shaft 94B is rotated around its axis by a driving source (not illustrated), the conductive roller 72 configuring the second transfer portion 70 vibrates in the apparatus depth direction and the apparatus height direction by the rotation of gears (not illustrated) of the conductive brushes 92A and 94A and the metal shafts 92B and 94B. The conductive belt CB also vibrates in the apparatus depth direction and the apparatus height direction by the vibration of the conductive roller 72. Consequently, in the case of the comparative exemplary embodiment, the toner MT (the toner MT configuring the toner image G1) adhering to the transfer belt TB in the standing state falls to the transfer belt TB alternately at the near side or the far side in the apparatus depth direction (one side or the other side in the width direction of the medium P), and is second transferred on the medium P in synchronization with the passing timing. Then, as shown in FIGS. 11A to 11C, if the toner MT configuring the second transferred toner image G1 is fixed to the medium P, an image is formed with a periodical variation in posture of the flat metal pigment MP inclined to the medium P alternately at the one side or the other side in the width direction of the medium P for a vibration period of the conductive roller 72. Then, if the toner image G1 with MT satisfies the predetermined condition (if included in the region A1 in FIG. 9), arrangement unevenness of the flat metal pigment MP is more likely visually recognized than the case not satisfying the predetermined condition.

Figure 10:
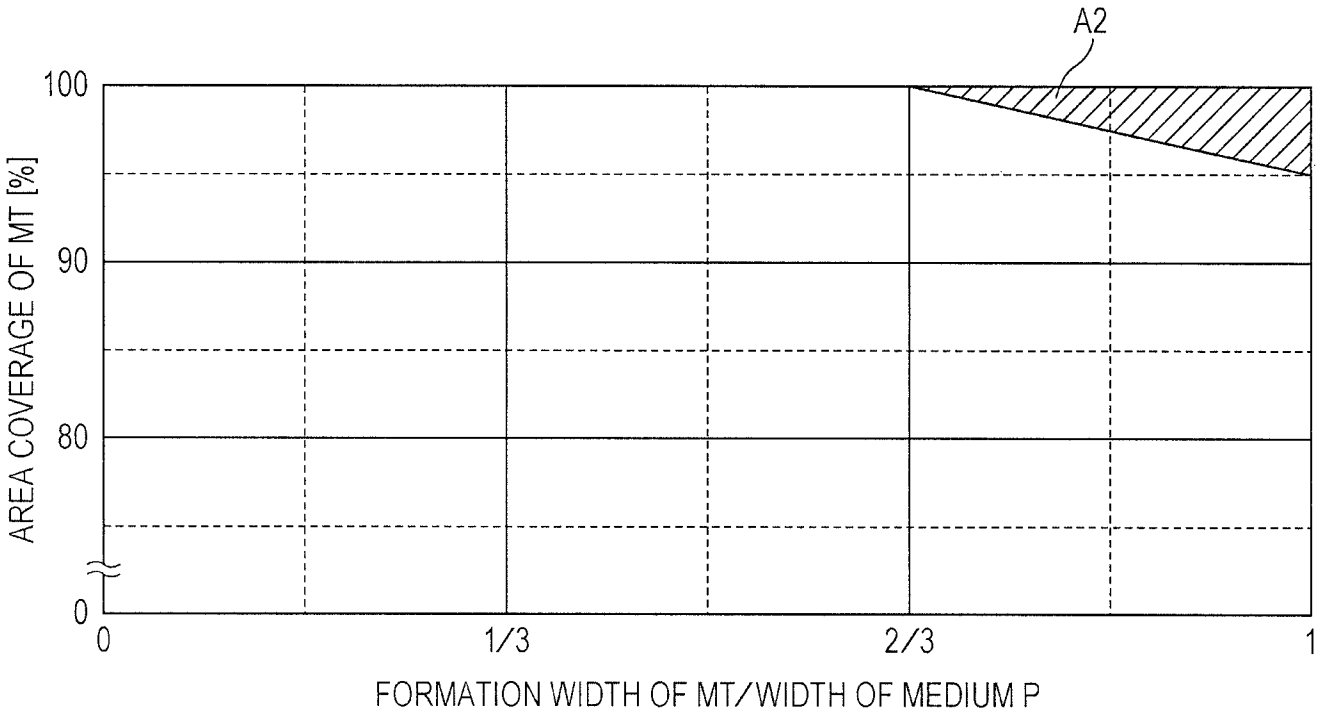
FIG. 10 is a graph showing a test result that serves as the basis of the predetermined condition in FIG. 9.

The predetermined condition is supplementary described. It may be expectedly considered that the toner MT more likely slips between the transfer belt TB and the medium P at the nip N2 as the formation width of the toner image G1 with the toner MT is larger and as the area coverage of the toner MT is higher. As described above, since the conductive belt CB vibrates in the apparatus depth direction and the apparatus height direction, it may be expectedly considered that the toner MT more likely slips at the nip N2 and falls in the apparatus depth direction (the vibration direction of the conductive belt CB) as the formation width of the toner image G1 with the toner MT is larger and the area coverage of the toner MT is higher. The inventor of this application found that, if the toner image G1 with the toner MT is in an area A2 in FIG. 10, an image in which arrangement unevenness of the flat metal pigment MP is more likely visually recognized is formed. Owing to this, in this exemplary embodiment, if the predetermined condition is satisfied (the region A1 in FIG. 9), it is assumed that the region A2 in FIG. 10 is included.

In contrast, in the case of the image forming apparatus 10 (the transfer device 30) of this exemplary embodiment, if the controller 60 determines YES in determining step S200 and in determining step S210, the toner image G1 on the transfer belt TB is second transferred on a medium P at the nip N2 while the first removing portion 92 or the second removing portion 94 is not driven as shown in FIG. 8.

Accordingly, with the image forming apparatus 10 (the transfer device 30) of this exemplary embodiment, an image with a smaller periodical variation in posture of the flat metal pigment MP may be formed as compared with the image forming apparatus (the transfer device) in which the toner image G1 with the toner MT is second transferred on the medium P while the first removing portion 92 and the second removing portion 94 are driven (rotated).

Second Effect

For the second effect, the image forming apparatus 10 (the transfer device 30) of this exemplary embodiment is described in comparison with an image forming apparatus (a transfer device) of a comparative exemplary embodiment described below. In the image forming apparatus of the comparative exemplary embodiment, step S210 in FIG. 8 is omitted (see FIG. 17). In other point of view, the image forming apparatus of the comparative exemplary embodiment does not determine whether or not a toner image G1 to be formed with the toner MT satisfies the predetermined condition. The image forming apparatus of the comparative exemplary embodiment has a similar configuration to that of the image forming apparatus 10 (the transfer device 30) of this exemplary embodiment except the above-described point. It is to be noted that the above-described comparative exemplary embodiment pertains to the technical scope of the invention.

Figure 17:
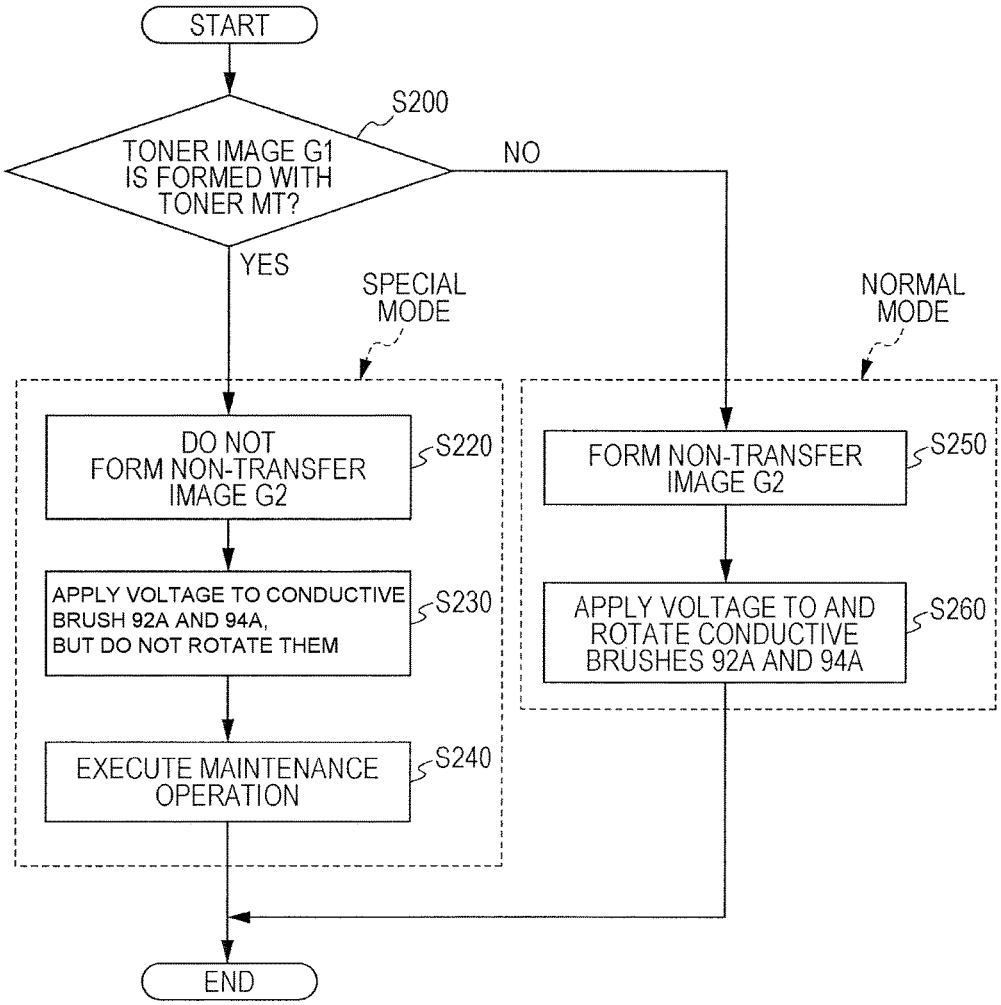
FIG. 17 is a flowchart when a controller configuring an image forming apparatus according to other exemplary embodiment controls a second transfer unit during a transfer operation.

In the image forming apparatus of the comparative exemplary embodiment, if the toner image G1 with the toner MT is formed, even though the controller 60 determines YES in determining step S210, an image forming operation is executed in the special mode (see FIG. 17). Owing to this, if the image forming apparatus of the comparative exemplary embodiment forms a toner image G1 with the toner MT satisfying the predetermined condition, an image in which arrangement unevenness of the flat metal pigment MP is more hardly visually recognized may be formed as compared with the image forming apparatus in which the removing unit 90 that removes a toner T adhering to the conductive belt CB is driven. However, if an image is formed with the toner MT and if the predetermined condition is not satisfied (that is, if a toner image is in a region other than the region A1 in FIG. 9), the image forming apparatus of the comparative exemplary embodiment is not able to execute the removing operation for the toner T adhering to the conductive belt CB by using the removing unit 90.

In contrast, if the controller 60 determines NO in determining step S210, the image forming apparatus 10 (the transfer device 30) of this exemplary embodiment executes an image forming operation in the normal mode as shown in FIG. 8.

Accordingly, in the image forming apparatus 10 (the transfer device 30) of this exemplary embodiment, if the controller 60 causes a toner image G1 with the toner MT which does not satisfy the predetermined condition to be formed, the removing operation for the toner T adhering to the conductive belt CB is able to be executed.

Third Effect

For the third effect, the image forming apparatus 10 (the transfer device 30) of this exemplary embodiment is described in comparison with an image forming apparatus (a transfer device) of a comparative exemplary embodiment described below. In the image forming apparatus of the comparative exemplary embodiment, the controller 60 does not cause the power supply PS to apply a voltage to the first removing portion 92 or the second removing portion 94 in step S230 in FIG. 8. The image forming apparatus (the transfer device) of the comparative exemplary embodiment has a similar configuration to that of the image forming apparatus 10 (the transfer device 30) of this exemplary embodiment except the above-described point.

In the image forming apparatus of the comparative exemplary embodiment, part of the toner T adhering to the conductive belt CB circulates together with the conductive belt CB, and contacts the conductive brushes 92A and 94A that are stopped and in contact with the conductive belt CB. However, since a voltage is not applied to the conductive brush 92A or 94A, the toner T on the conductive belt CB being in contact with the conductive brushes 92A and 94A is hardly transferred from the conductive belt CB to the conductive brushes 92A and 94A. Hence the toner T may circulate together with the conductive belt CB and reach the nip N2. When the toner T reaches the nip N2, the toner T adheres to the back surface of the medium P (a surface of the medium P opposite to a surface on which the toner image G1 is transferred), and may contaminate the back surface of the medium P.

In contrast, in the image forming apparatus 10 (the transfer device 30) of this exemplary embodiment, as shown in FIG. 8, if the controller 60 determines YES in determining step S210, the controller 60 causes the power supply PS to apply a voltage to the first removing portion 92 and the second removing portion 94 in step S230. Owing to this, the toner T on the conductive belt CB being in contact with the conductive brushes 92A and 94A is likely transferred from the conductive belt CB to the conductive brushes 92A and 94A.

Accordingly, in the image forming apparatus 10 (the transfer device 30) of this exemplary embodiment, if the controller 60 causes a toner image G1 with the toner MT which satisfies the predetermined condition to be formed, the amount of toner T to be transferred from the conductive belt CB to the conductive brushes 92A and 94A is larger than that of the image forming apparatus that does not apply a voltage to the conductive brush 92A or 94A.

Fourth Effect

For the fourth effect, the image forming apparatus 10 (the transfer device 30) of this exemplary embodiment is described in comparison with an image forming apparatus (a transfer device) of a comparative exemplary embodiment described below. In the image forming apparatus of the comparative exemplary embodiment, step S240 in the special mode in FIG. 8 is omitted. That is, in the case of the image forming apparatus of the comparative exemplary embodiment, the maintenance operation of the second transfer unit 36 is not executed after step S230 in the special mode. The image forming apparatus (the transfer device) of the comparative exemplary embodiment has a similar configuration to that of the image forming apparatus 10 (the transfer device 30) of this exemplary embodiment except the above-described point.

In the case of the image forming apparatus of the comparative exemplary embodiment, the toner T on the conductive belt CB being in contact with the conductive brushes 92A and 94A is transferred from the conductive belt CB to the conductive brushes 92A and 94A during the transfer operation to the medium P. In the case of the image forming apparatus of the comparative exemplary embodiment, after the controller 60 causes the second transfer unit 36 to complete transferring the toner image G1 formed by the single-color unit 21G onto the medium P (after the transfer operation in accordance with job data is completed), the image forming operation is ended while the toner T is transferred to the conductive brushes 92A and 94A. Owing to this, in the case of the image forming apparatus of the comparative exemplary embodiment, if a transfer operation is executed in accordance with the next job data, the toner T transferred to the conductive brushes 92A and 94A circulates together with the conductive belt CB and reaches the nip N2. When the toner T reaches the nip N2, the toner T adheres to the back surface of the medium P (a surface of the medium P opposite to a surface on which the toner image G1 is transferred).

In contrast, in the image forming apparatus 10 (the transfer device 30) of this exemplary embodiment, as shown in FIG. 8, after step S230, the maintenance operation of the second transfer unit 36 is executed in step S240. Owing to this, in the case of the image forming apparatus 10 (the transfer device 30) of this exemplary embodiment, the toner T transferred to the conductive brushes 92A and 94A by the metal shafts 92B and 94B is removed from the conductive brushes 92A and 94A, and then the image forming operation is ended.

Accordingly, in the image forming apparatus 10 (the transfer device 30) of this exemplary embodiment, the toner T transferred to the conductive brushes 92A and 94A is removed from the conductive brushes 92A and 94A after the transfer operation in accordance with the job data is ended and before the image forming operation is ended.

Second Exemplary Embodiment

Next, a second exemplary embodiment is described. In the following description, if the same component as that used in the first exemplary embodiment is used in this exemplary embodiment, the reference sign of the component is used without change.

Configuration

Figure 12:
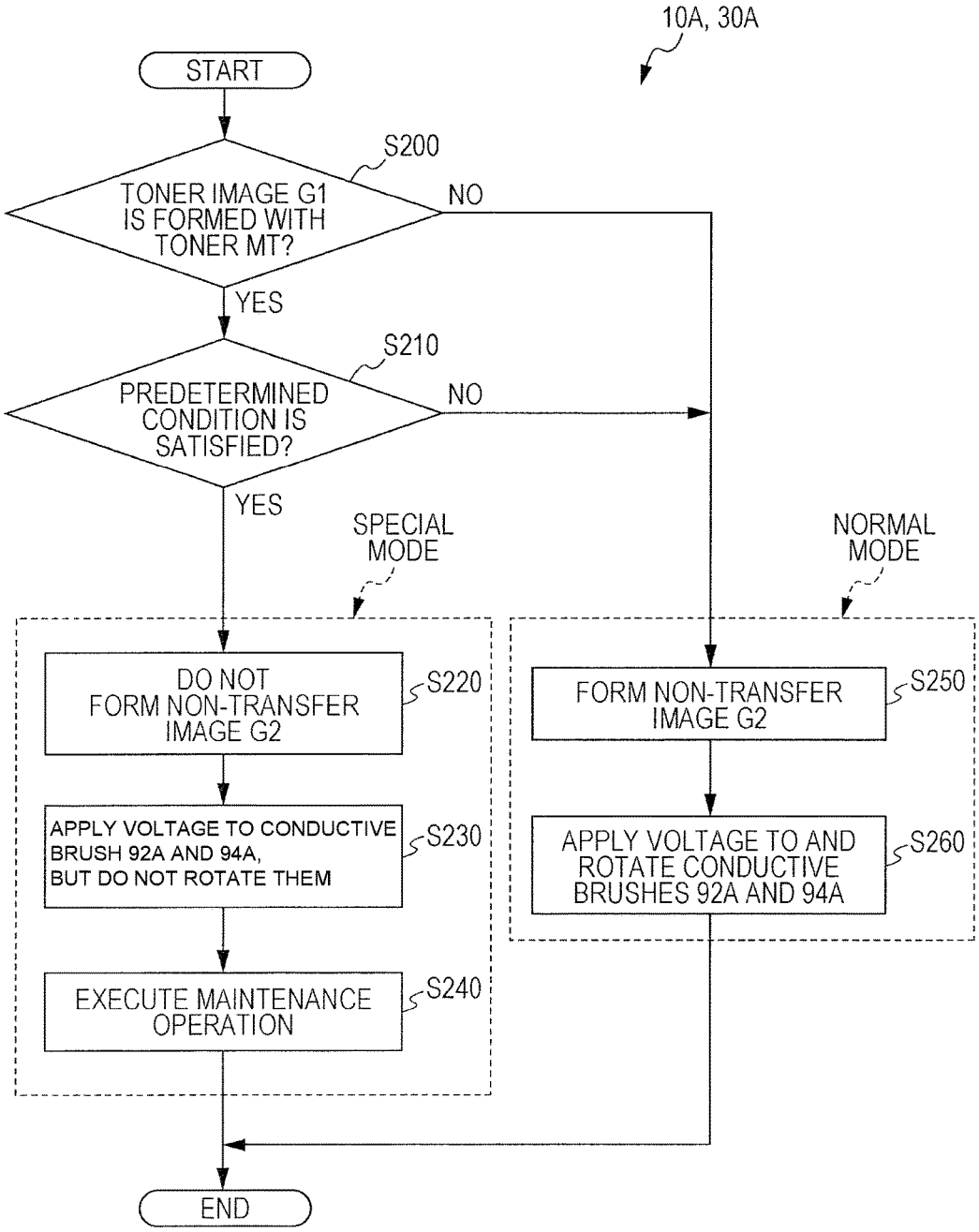
FIG. 12 is a flowchart when a controller configuring an image forming apparatus according to a second exemplary embodiment controls a second transfer unit during a transfer operation.

As shown in FIG. 12, an image forming apparatus 10A (a transfer device 30A) of this exemplary embodiment differs from the image forming apparatus 10 of the first exemplary embodiment (see FIG. 8) in that the non-transfer image G2 is not formed in step S220 in the special mode. The image forming apparatus 10A of this exemplary embodiment has a configuration similar to that of the image forming apparatus 10 of the first exemplary embodiment except the above-described point.

Effect

In the case of the image forming apparatus 10A of this exemplary embodiment, if the controller 60 causes the image forming operation to be executed in the special mode, the controller 60 does not cause the single-color unit 21 to form the non-transfer image G2. Owing to this, the amount of toner T adhering to the conductive belt CB is decreased. Other effect of this exemplary embodiment is similar to the effects (first to fourth effects) of the first exemplary embodiment.

Third Exemplary Embodiment

Next, a third exemplary embodiment is described. In the following description, if the same component as that used in the first exemplary embodiment is used in this exemplary embodiment, the reference sign of the component is used without change.

Configuration

Figure 13:
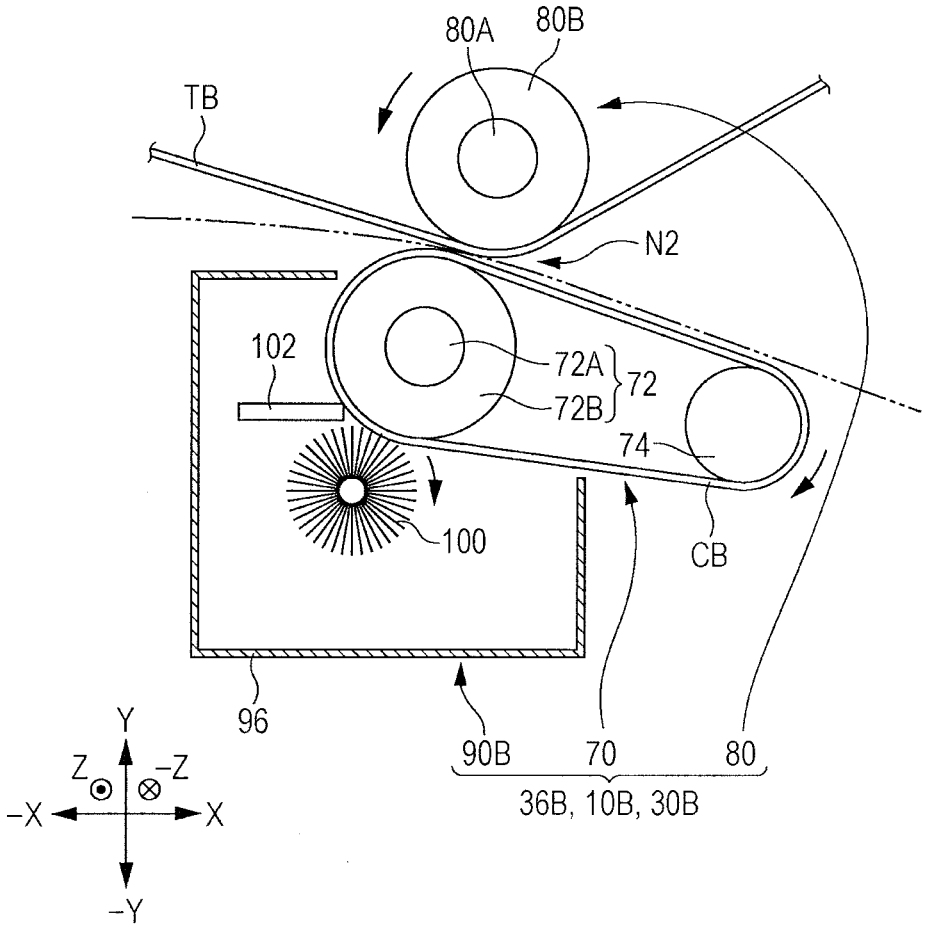
FIG. 13 is a schematic view of a peripheral area of a second transfer unit of a transfer device configuring an image forming apparatus according to a third exemplary embodiment.
Figure 14:
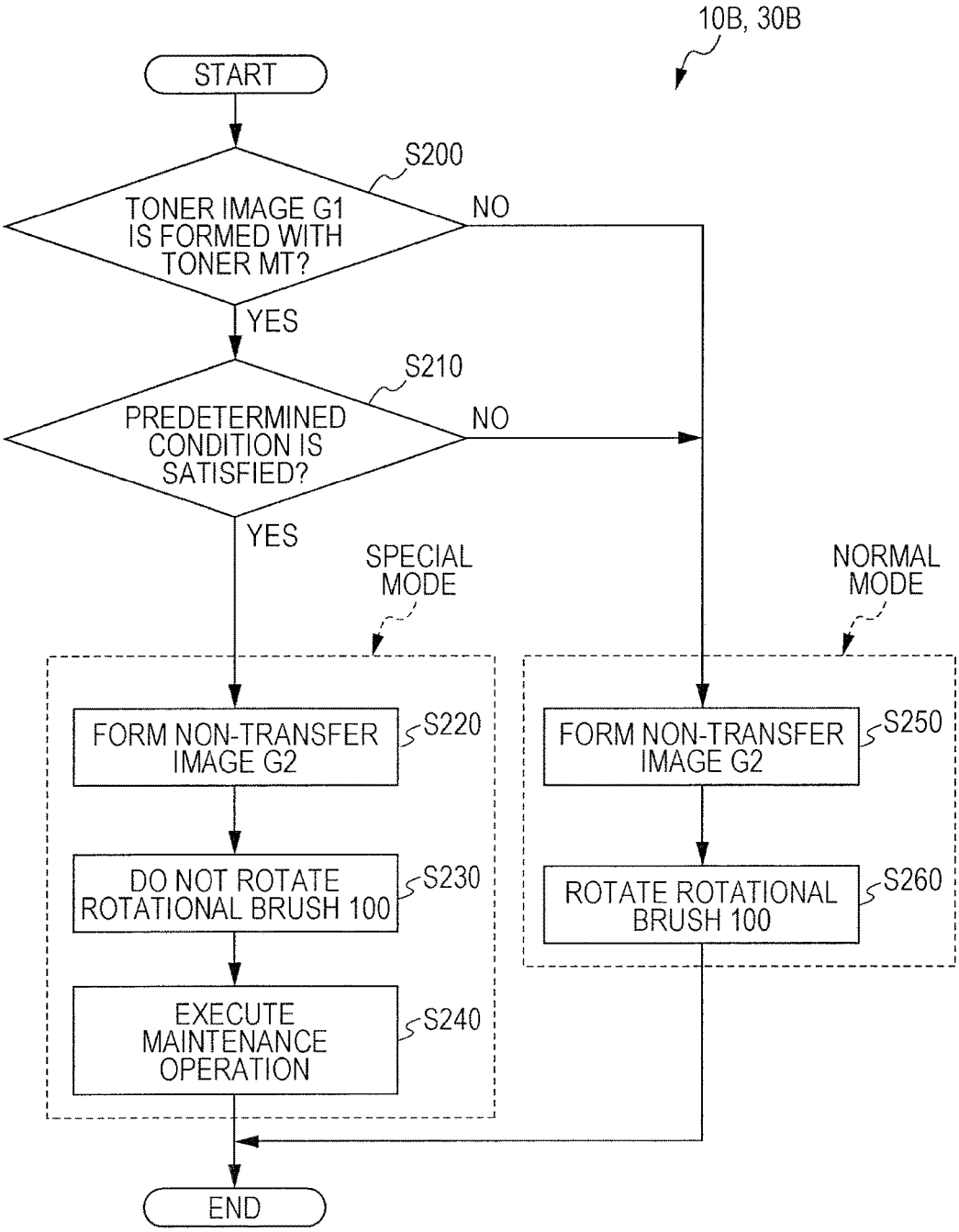
FIG. 14 is a flowchart when a controller configuring the image forming apparatus according to the third exemplary embodiment controls the second transfer unit during a transfer operation.

As shown in FIG. 13, an image forming apparatus 10B of this exemplary embodiment includes a rotational brush 100 and a blade 102 at a removing unit 90B configuring a second transfer unit 36B, instead of the first removing portion 92 and the second removing portion 94 configuring the removing unit 90, as compared with the image forming apparatus 10 (see FIG. 3) of the first exemplary embodiment. The rotational brush 100 is an example of a rotational body. The rotational brush 100 rotates around its axis in a state biting into the conductive belt CB, and contacts the conductive belt CB. Also, the blade 102 contacts the conductive belt CB at a position located downstream of the rotational brush 100 and upstream of the nip N2 in the circulation direction of the conductive belt CB, and removes the toner T adhering to the conductive belt CB. Also, in the case of the image forming apparatus 10B of this exemplary embodiment, the controller 60 causes the image forming operation to be executed according to a flowchart in FIG. 14. The flowchart in FIG. 14 differs from the flowchart of the first exemplary embodiment (see FIG. 8) in step S230, step S240, and step S260. To be specific, the controller 60 does not cause the rotational brush 100 to rotate (or even a voltage is not applied) in step S230 of this exemplary embodiment. Also, when the controller 60 causes the rotational brush 100 to rotate in step S240, the controller 60 does not cause a voltage to be applied. The image forming apparatus 10B of this exemplary embodiment has a configuration similar to that of the image forming apparatus 10 of the first exemplary embodiment except the above-described point.

Effect

Effects of this exemplary embodiment are similar to the effects of the first exemplary embodiment (first, second, and fourth effects).

Fourth Exemplary Embodiment

Next, a fourth exemplary embodiment is described. In the following description, if the same component as that used in the first and third exemplary embodiments is used in this exemplary embodiment, the reference sign of the component is used without change.

Configuration

Figure 15:
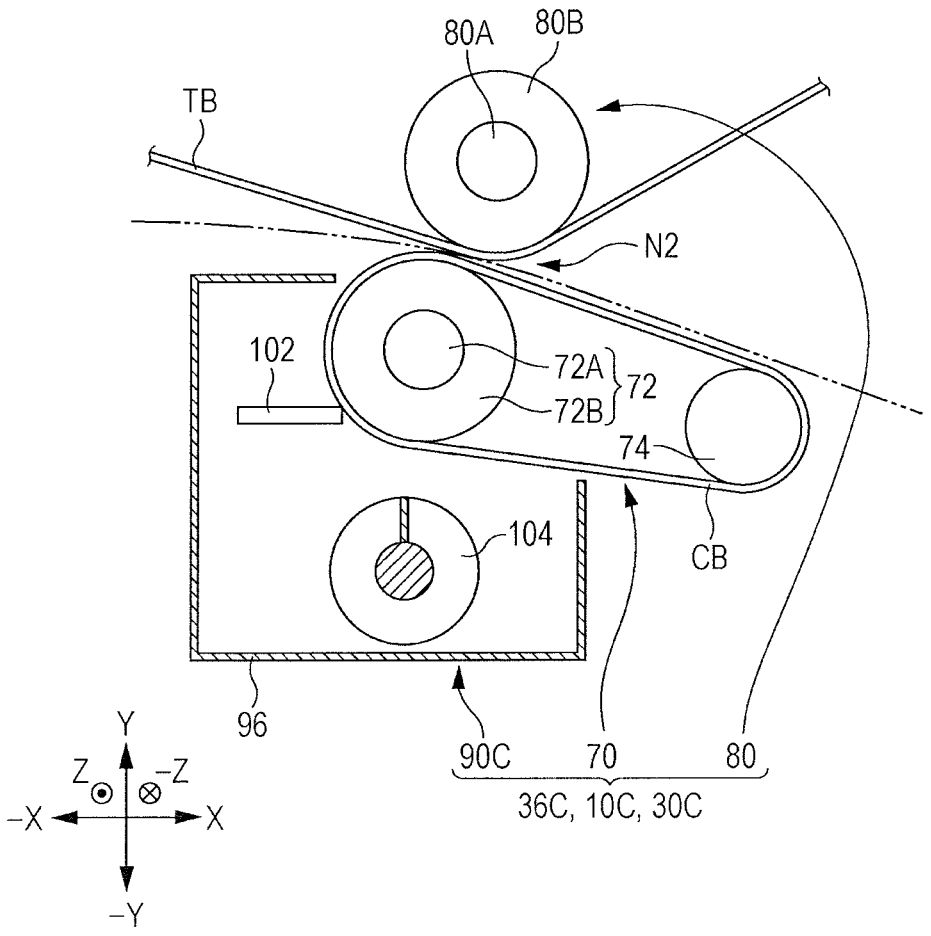
FIG. 15 is a schematic view of a peripheral area of a second transfer unit of a transfer device configuring an image forming apparatus according to a fourth exemplary embodiment.
Figure 16:
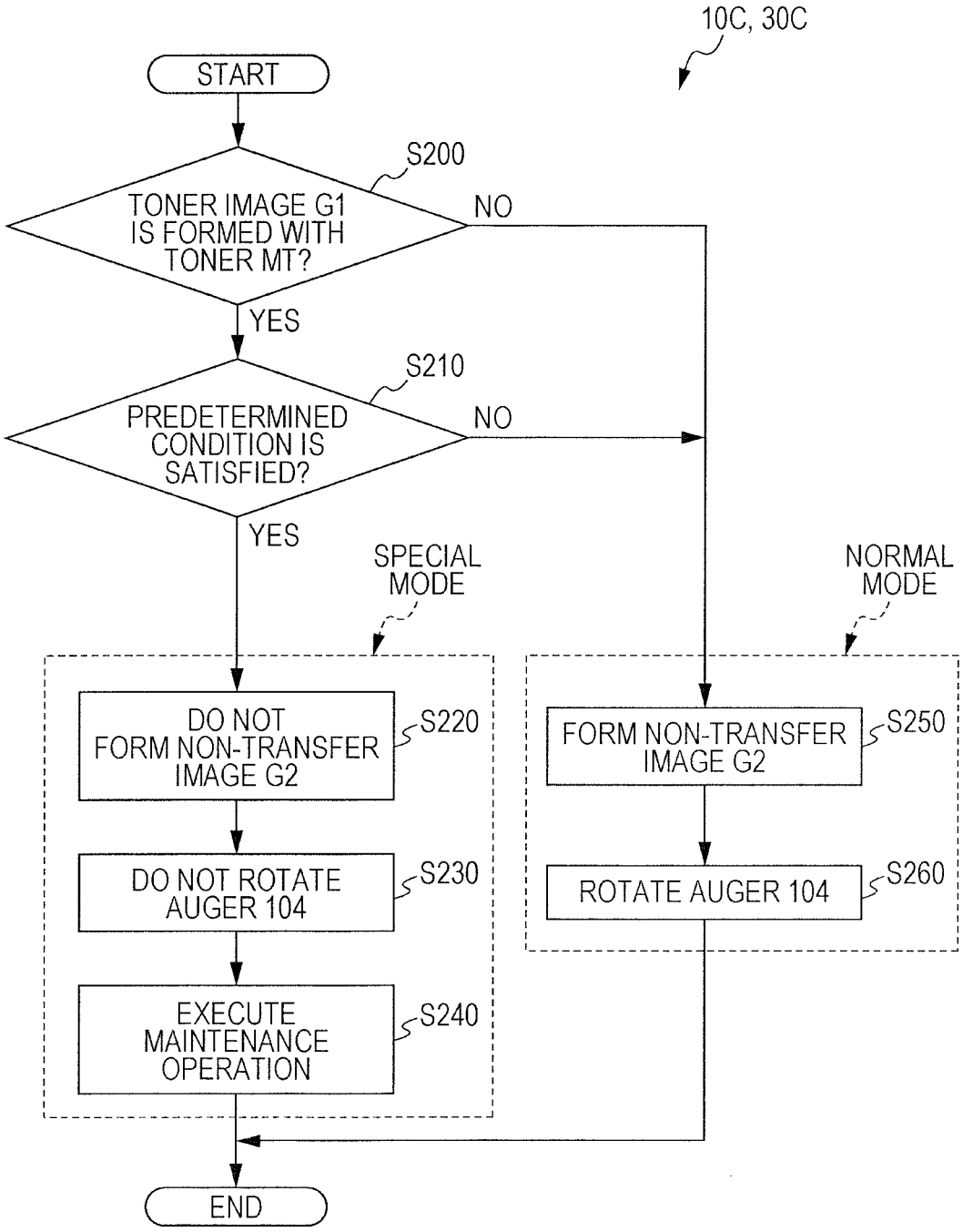
FIG. 16 is a flowchart when a controller configuring the image forming apparatus according to the fourth exemplary embodiment controls the second transfer unit during a transfer operation.

As shown in FIG. 15, an image forming apparatus 10C of this exemplary embodiment includes a blade 102 and an auger 104 at a removing unit 90C configuring a second transfer unit 36C, instead of the first removing portion 92 and the second removing portion 94 configuring the removing unit 90, as compared with the image forming apparatus 10 (see FIG. 3) of the first exemplary embodiment. The auger 104 is an example of a rotational body. The auger 104 is separated from the conductive belt CB and is arranged below the conductive belt CB. The auger 104 rotates around its axis, transports the toner T accumulated in the housing 96 in the axial direction (the apparatus depth information), and is output from an opening (not illustrated) formed in a wall surface of the housing 96. The output toner T is housed in a waste toner tank (not illustrated). Also, in the case of the image forming apparatus 10C of this exemplary embodiment, the controller 60 causes the image forming operation to be executed according to a flowchart in FIG. 16. The flowchart in FIG. 16 differs from the flowchart of the first exemplary embodiment (see FIG. 8) in step S230, step S240, and step S260. To be specific, the controller 60 does not cause the auger 104 to rotate (or even a voltage is not applied) in step S230 of this exemplary embodiment. Also, when the controller 60 causes the auger 104 to rotate in step S240, the controller 60 does not cause a voltage to be applied. The image forming apparatus 10C of this exemplary embodiment has a configuration similar to that of the image forming apparatus 10 of the first exemplary embodiment except the above-described point.

Effect

Other effect of this exemplary embodiment is similar to the effects of the first exemplary embodiment (first, second, and fourth effects).

The invention has been described above in detail based on the specific exemplary embodiments; however, the invention is not limited to the above-described exemplary embodiments and other exemplary embodiment may be employed within the scope of the technical idea of the invention.

For example, in the image forming apparatus 10 of the first exemplary embodiment, the controller 60 determines determining step S200, determining step S210, etc., and executes the image forming operation (mode) in accordance with the determination. However, the mode executed in accordance with each determination is merely an example, and the image forming apparatus 10 of the first exemplary embodiment may include other mode. The image forming apparatuses 10A, 10B, and 10C of other exemplary embodiments may be configured similarly.

Also, the toner MT used by the image forming apparatus 10 of the first exemplary embodiment is gold color. However, the toner MT may not be gold color as long as the toner MT is a flat toner containing a flat metal pigment. For example, the toner MT may be silver color. The image forming apparatuses 10A, 10B, and 10C of other exemplary embodiments may be configured similarly.

Also, as shown in FIG. 1, in the image forming apparatus 10 of the first exemplary embodiment, the single-color unit 21G that uses the toner MT is arranged at the most upstream side in the moving direction of the transfer belt TB in the toner image forming unit 20. However, the arrangement order of the single-color unit 21G may be any order as long as the toner image forming unit 20 includes the single-color unit 21G.

Also, in the image forming apparatus 10 of the first exemplary embodiment, the second transfer voltage is applied to the BUR 80 and the conductive roller 72 configuring the second transfer portion 70 is grounded. However, the second transfer voltage may be applied to the conductive roller 72 and the BUR 80 may be grounded.

Also, in the image forming apparatus 10 of the first exemplary embodiment, the conductive belt CB is an example of the transfer unit. However, instead of providing the conductive belt CB and the tension roller 74 like the second transfer portion 70, for example, the nip N2 may be formed by the conductive roller 72 and the transfer belt TB. In this case, the conductive roller 72 serves as an example of the transfer unit. The image forming apparatuses 10A, 10B, and 10C of other exemplary embodiments may be configured similarly.

Also, in the image forming apparatus 10 of the first exemplary embodiment, the removing unit 90 configuring the second transfer unit 36 includes the first removing portion 92 and the second removing portion 94. However, one of the first removing portion 92 and the second removing portion 94 may be omitted as long as the removing unit 90 includes a rotational body that rotates around its axis. The image forming apparatuses 10A of the second exemplary embodiment may be configured similarly.

Also, in the image forming apparatus 10 of the first exemplary embodiment, voltages are applied to the metal shafts 92B and 94B of the first removing portion 92 and the second removing portion 94. However, voltages may be directly applied to the conductive brushes 92A and 94A. In this case, instead of the metal shafts 92B and 94B, the first removing portion 92 and the second removing portion 94 may have plates that contact the conductive brushes 92A and 94A, and the plates may remove the toner T held by the conductive brushes 92A and 94A from the conductive brushes 92A and 94A. In this case, the plates are each an example of a removing portion.

In the image forming apparatus 10 of the first exemplary embodiment, the above-described predetermined condition is that the ratio of the formation width of the toner MT with respect to the width of the medium P is ⅔ or larger (1 or smaller), and the area coverage of the toner MT is 95% or higher (100% or lower) as shown in the graph in FIG. 9. However, the condition may be other condition because the condition is based on the sensory evaluation for evaluating whether or not an image whose arrangement unevenness of the flat metal pigment MP is likely visually recognized is formed. For example, the predetermined condition may be that the ratio of the formation width of the toner MT with respect to the width of the medium P is ½ or larger (1 or smaller) and the area coverage of the toner MT is 95% or higher (100% or lower).

In the description of the exemplary embodiments, first to fourth exemplary embodiments are provided. However, of course, an exemplary embodiment with the configurations of the respective exemplary embodiments combined may be included in the technical scope of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a first forming unit configured to form a first image with a substantially flat toner containing a substantially flat metal pigment on a moving movable body;

a second forming unit configured to form a second image with a substantially non-flat toner on the movable body;

a transfer unit configured to form a nip with the movable body while circulating and configured to transfer the first image and the second image onto a medium transported to the nip;

a removing unit comprising a rotational body and configured to remove the toners adhering to the transfer unit, the rotational body configured to rotate around an axis of the rotational body; and a controller configured to stop the rotation of the rotational body around the axis at a time when the transfer unit transfers the first image to the medium.

2. The image forming apparatus according to claim 1, wherein the substantially non-flat toner has a substantially spherical shape.

3. An image forming apparatus, comprising:

a first forming unit configured to form a first image with a substantially flat toner containing a substantially flat metal pigment on a moving movable body;

a second forming unit configured to form a second image with a substantially non-flat toner on the movable body;

a transfer unit configured to form a nip with the movable body while circulating and configured to transfer the first image and the second image onto a medium transported to the nip;

a removing unit comprising a rotational body and configured to remove the toners adhering to the transfer unit, the rotational body configured to rotate around an axis of the rotational body; and a controller configured to stop the rotation of the rotational body around the axis at a time when the controller controls the transfer unit to transfer the first image to the medium, the first image corresponding to a first image satisfying a predetermined condition.

4. The image forming apparatus according to claim 3, wherein the substantially non-flat toner has a substantially spherical shape.

5. The image forming apparatus according to claim 3, wherein, at a time when the controller controls the first forming unit to form the first image that does not satisfy the predetermined condition, the controller is configured to control the rotational body to rotate around the axis.

6. The image forming apparatus according to claim 3, wherein each of the first forming unit and the second forming unit is configured to form a non-transfer image that is not transferred on the medium transported to the nip, and wherein, at a time when the controller controls the first forming unit to form the first image that satisfies the predetermined condition, the controller is configured to control the first forming unit or the second forming unit to not form the non-transfer image.

7. The image forming apparatus according to claim 3, wherein the predetermined condition corresponds to a condition where a transfer width of the first image with respect to a width of the medium in a direction intersecting with a transport direction of the medium is larger than or equal to a predetermined width, and an area coverage of the first image is greater than or equal to a predetermined area coverage.

* * * * *